United States Patent [19]

Peterson

[11] Patent Number: 4,691,552

[45] Date of Patent: Sep. 8, 1987

[54] HEAD FOR BLIND RIVET INSTALLATION TOOLS

[76] Inventor: Richard B. Peterson, Rte. 1, Box 674, Vashon, Wash. 98070

[21] Appl. No.: 818,475

[22] Filed: Jan. 13, 1986

[51] Int. Cl.[4] ..... B21J 15/32

[52] U.S. Cl. ..... 72/391; 29/243.53

[58] Field of Search ..... 72/391, 453.17, 453.19, 72/114; 29/243.53

[56] References Cited

U.S. PATENT DOCUMENTS

| | | | |
|---|---|---|---|
| 3,196,662 | 7/1965 | Simmons | 72/391 |
| 3,363,445 | 1/1968 | Sanders et al. | 72/391 |
| 3,543,560 | 12/1970 | Harris | 72/391 |
| 3,695,086 | 10/1972 | Savage | 72/391 |
| 4,000,668 | 1/1977 | Keasler | 72/391 |
| 4,368,838 | 1/1983 | Sheffield et al. | 72/391 |
| 4,375,760 | 3/1983 | Savage et al. | 72/391 |
| 4,552,010 | 11/1985 | Hein | 72/391 |

*Primary Examiner*—Lowell A. Larson
*Assistant Examiner*—David B. Jones
*Attorney, Agent, or Firm*—Robert W. Jenny

[57] ABSTRACT

The improvement of the head of the blind rivet driving tool comprises (1) configuring and proportioning the head so that insertion of the shank of a blind rivet assembly into the tip of the head for installation causes the expendable portion of the rivet assembly previously installed to partially exit from the exit end of the head and (2) apparatus at the exit end which retains the expendable portion in the head until it is caused to partially exit and then holds the expendable portion unit it is extracted by the operator. The longitudinal axes of the head, its tip, casing and retention apparatus are essentially coincident. A preferred embodiment of the retention apparatus comprises a resilient wafer having a plurality of wedge shaped leaf spring segments extending from the rim of the wafer toward its center, the ends of the segments forming a segmented periphery of a hole having a diameter somewhat smaller than that of the rivet shank. As a shank portion is expelled the segments deflect to form a segmented periphery with a diameter large enough to allow the exit of the shank portion.

4 Claims, 8 Drawing Figures

FIG. 5
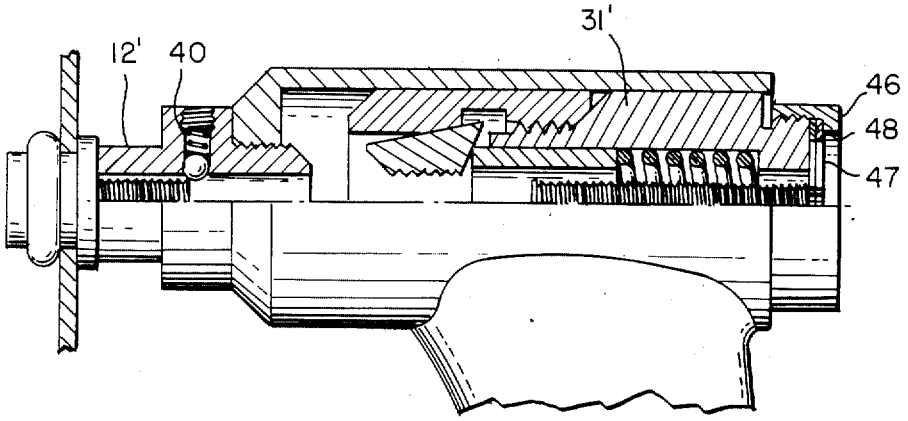
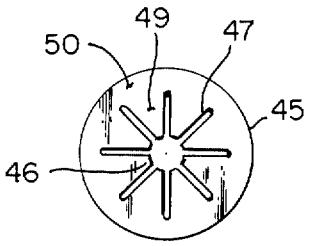
FIG. 5A
FIG. 6
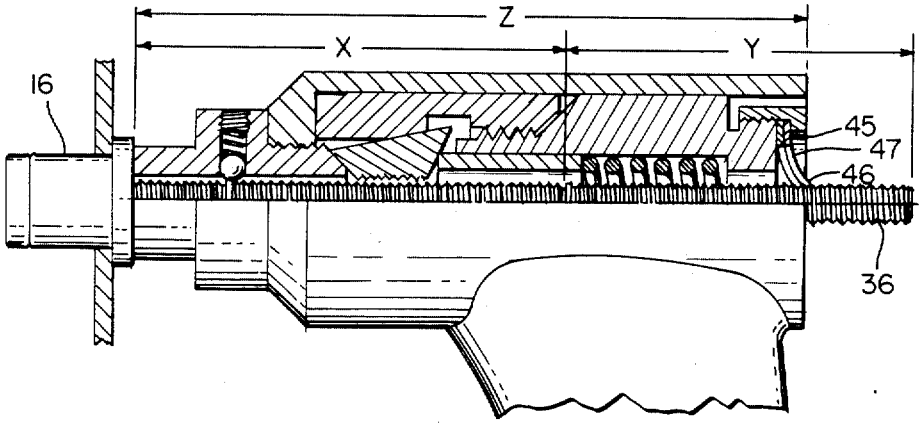

HEAD FOR BLIND RIVET INSTALLATION TOOLS

BACKGROUND OF THE INVENTION

1. Field of the Invention

The subject invention is in the field of tools for installing fasteners, more specifically tools for installing blind fasteners, so-called because they can be installed from one side of the work material into which they are installed without need for tooling or manual assistance on the opposite side. More specifically, it relates to tools for installing rivets which are fixed in place by (1) inserting the head end of the rivet assembly through the hole into which the rivet is to be installed and then (2) while the rivet is held in place, applying tension to the shank of the assembly. The rivets are designed so that the tension first causes swelling of the head end on the blind side of the work material and second, causes that portion of the shank provided for installation purposes only to break free from the rivet. The swelling holds the rivet in place. The point at which the shank breaks off is determined by a necking down of the shank diameter.

2. Prior Art

The prior art in this field is profuse. However, the subject improved features have been applied to a specific commercially available rivet installation tool and, therefore, that tool constitutes the prior art of immediate interest. The tool is model PH2001, manufactured by Gesipa, G.m.b.H., Walldorf/Frankfort, West Germany. A print of a sectional view of this tool is attached.

Two problems have been found with the tool in the course of its use and these problems have led to the subject invention. In regard to the first problem, in the use of such tools the rivet assembly is inserted shank first into the head of the tool and then the tool is maneuvered into the position for installation of the rivet. It has been found that the rivets often fall out of the tool in the course of the maneuvering. This causes serious loss of time, inconvenience and possibly safety hazards if not enough care is taken in finding and retrieving the dropped rivet assemblies. Lost assemblies can interfere adversely with other mechanisms, electrical systems and the like.

In regard to the second problem, related to the first in the results it produces, is that the shank portions broken off in the installation procedure are ejected from the head of the tool. In instances where installation space allows, these shanks are caught and collected in a container provided with and attached to the tool. However, the requirement for the space for the container has been found to seriously limit the utility of the tool, thus presenting the problem of preventing the ejection of the shanks while not complicating their removal from the tool head at the user's convenience. To summarize, the problems leading to the subject invention were retention of the rivet assembly in the installation tool while the tool is maneuvered into each operating position and prevention of ejection of the expendable portions of the shanks, using a minimum of space in order to optimize accessibility of the tool to use locations.

BRIEF SUMMARY OF THE INVENTION

To retain the rivet assemblies in the tool head during the maneuvering of the tool into working position, at least one ball detent is located in the nose piece of the tool into which the rivet assembly shank is inserted. The line of action of the detent is essentially perpendicular to the hole that receives the shank and the centerline of the detent apparatus intersects the centerline of the hole for the shank. The detent details are as follows: A hole is provided normal to the shank hole and having a restriction which allows a ball bearing in the hole to extend partway across the shank hole but prevents the ball from completely entering the shank hole. The extension of the ball into the hole is enough so that the shank cannot be in the shank hole without moving the ball off of the restriction. The ball is pressed against the restriction or a shank by a compression spring in the detent hole and the spring is held in place by a plug threaded into threads provided in the hole or by a plug or pin pressed into the hole for the purpose. In the preferred embodiment two detents are used.

The broken-off shanks are retained until extracted by the tool operator by at least one resilient wafer installed at the exit end of the shank hole. The wafer is circular with its center essentially intersected by the centerline of the shank hole. There is a hole in the center of the wafer, its diameter being somewhat smaller than the diameter of the rivet shanks. A plurality of slots or cuts extend radially from the center hole, the slots extending approximately two thirds of the radius of the wafer. The segments of the wafer between the slots function as leaf springs, flexing into and out of the plane of the wafer. The wafer is retained by an internally threaded, flanged ring which threads onto external threads provided on the end of the part through which the expendable flange parts emerge. The parts cannot emerge without deflecting the leaf springs in the wafer in the direction of the emergent motion. The spring pressures hold the part until the operator grasps it and removes it.

In a preferred embodiment two wafers are used next to each other.

In operation the rivet assembly shank is inserted into the tool head. The rivet is installed. The shank part is prevented from exiting the shank hole by the wafers. When the next rivet assembly is inserted the end of the inserted assembly forces the end of the shank part partway through the opening in the wafer(s) so that the end of the part can be grasped and the part removed by the operator.

It is considered to be made clear by this description that the subject invention meets its objectives of extending the utility of the prior art tool by enabling retention of rivet assemblies in the tool while the tool is maneuvered into working positions and preventing ejection of the expendable portions of the rivet assemblies.

BRIEF DESCRIPTION OF THE DRAWINGS

FIG. 5 is a sectional view of the head of the tool incorporating the subject invention with the rivet assembly installed and the expendable portion of the shank separated and retained in the head.

FIG. 5A shows a wafer in plane view.

FIG. 6 is a sectional view of the head of the tool incorporating the subject invention, in condition for beginning a new operation with a rivet assembly installed and the expendable portion of shank from the previous operation moved partway out of the head by the insertion of the succeeding rivet assembly.

DETAILED DESCRIPTION OF THE INVENTION

Tools of the type to which the subject invention applies are used for installing blind rivets. Such rivets are, in fact, assemblies, comprising (1) the actual rivet which, when installed, is retained in the work material and (2) components which enable installing the rivet blind. The term blind signifies that the work material is accessible, for rivet installation purposes at least, from only one side. However, blind rivet use is not limited to such situations. In some instances the rivets fasten two or more work parts together. In others the rivet serves as a means of anchoring to the work part(s) a useful item such as a threaded stud to which electrical connections can be made, for example. In each instance, however, the rivet assembly comprises the rivet element having a head and a part called a shank. In installation, the rivet assembly is inserted into the hole in the work material with the head forced against the work material and then the shank is pulled, the tension force being in the opposite direction to that of the force holding the rivet assembly in place. The tension on the shank causes the rivet element to expand and be held in place for its design purposes. A portion of the shank is expendable for the design purposes, the purpose for the expendable portion being only its function in the installation. The tension force used in installing the rivet assembly removes the expendable portion at a point determined by a necking down of the diameter of the shank. The force applied to the rivet installation is determined by the tensile strength of the shank at the necked down point.

Once the rivet assembly has expanded and the expendable shank portion separated from the shank, the installation is complete. However, in many instances the separation of the expendable portion is very sudden and the apparatus which applies the tension for installation purposes has reserve energy which expels the separated portion from the tool head with considerable energy. This expulsion is undesirable if not intolerable because of the possibility of infliction of inquires by the ejected material and because, in many instances, the material must not be allowed to be left in the work area since such parts can interfere with the function of other apparatus.

Also, because of their capabilities, blind rivets are often used in places where accessibility of difficult and/or limited to the extent that the tool must be maneuvered into almost any position relative to vertical, with the result that a rivet assembly inserted into the tool head may fall out. This is troublesome and costly and to be avoided if at all possible.

Figure 1:
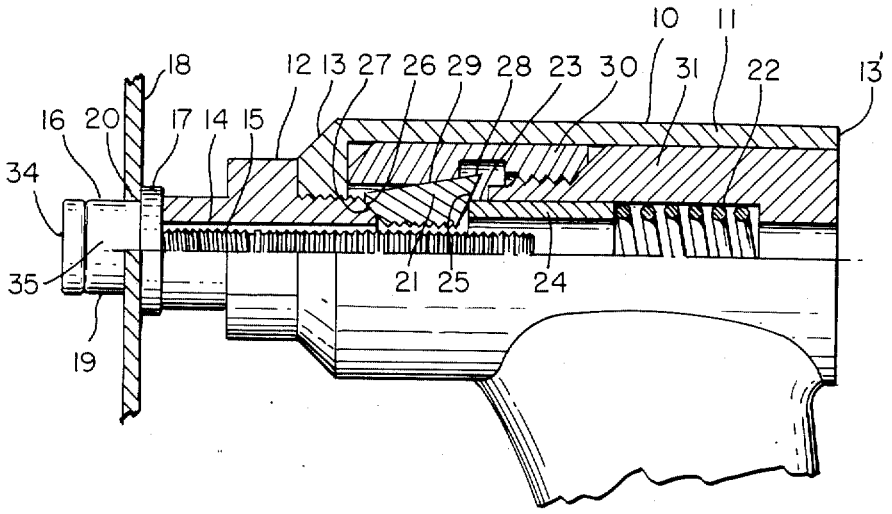
FIG. 1 PRIOR ART
FIG. 1 is a sectional view of the head of the rivet installation tool in prior art condition.

These two undersirable aspects of use of the prior art tool are eliminated by the subject invention. Referring to FIG. 1 which is a sectional view of the prior art tool with a rivet assembly inserted for installation, tool head 10 comprises casing 11 and tip 12, threaded into end 13 of casing 11. Hole 14 in tip 12 accepts shank 15 of rivet assembly 16. Head 17 of the rivet assembly is pressed against work material 18 and rivet body 19 extends through hole 20 in the work material. Inside the casing, the shank is positioned to be engaged by three jaws, jaw 21 being one of the three. When the tool mechanism is at rest the jaws are held out of engagement with the shank as follows: Compression spring 22 forces end 23 of tube 24 against end(s) 25 of the jaw(s), thus, also forcing end(s) 26 of the jaw(s) against conical surface 27 on tip 12. Because of the slopes of ends 25 and 26, each jaw is forced radially outward from the shank until jaw(s) surface(s) 28 contacts conical surface 29 on part 30. Part 30 is connected to part 31 by the threaded connection 32.

Figure 2:
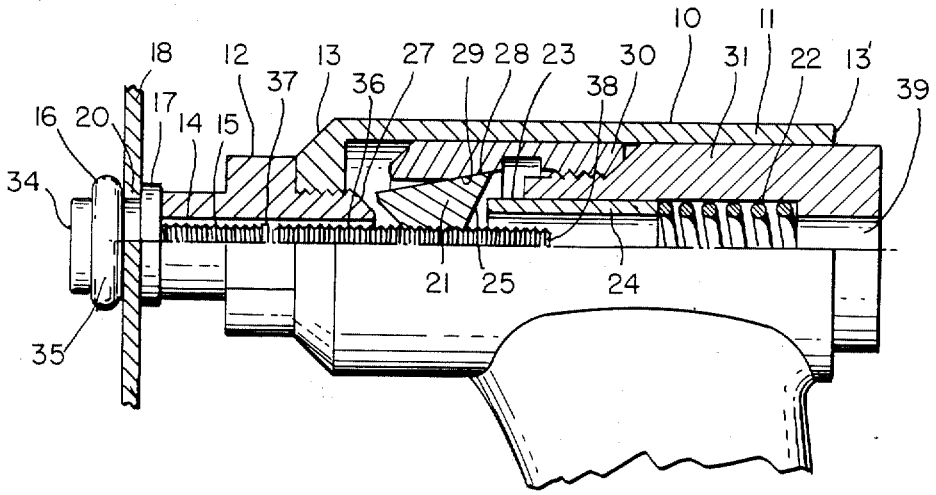
FIG. 2 PRIOR ART
FIG. 2 is a sectional view of the head of the tool in a stage of operation in which the rivet assembly is installed, but before the expendable portion of the shank is separated.
Figure 3:
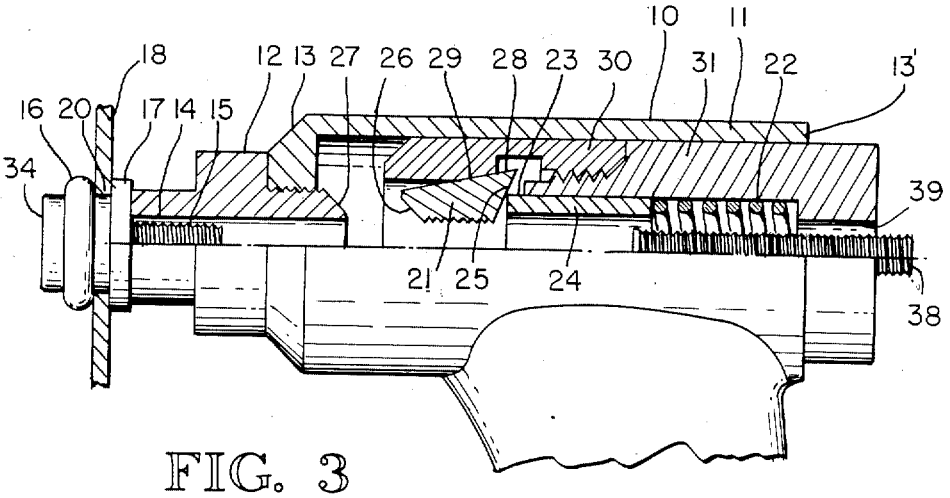
FIG. 3 PRIOR ART
FIG. 3 is a sectional view of the head of the tool in the stage of operation after the expendable portion of the shank has separated and is exiting the tool head.

To install the rivet assembly, parts 30 and 31 are forcefully moved past end 13' of casing 11 in the direction away from the work material by mechanism in the tool not related to the subject invention. This motion causes the conical surface 29 to cam the jaws inward toward the shank, overcoming the outward force of tube 24 on jaw surface 25. As jaws are drawn away from tip 12, the outward force on surface 26 is also relieved, allowing the jaws to be forced into firm contact with the serrated surface 33 of shank 15. Further motion of parts 30 and 31 causes shank to move with parts 30 and 31, so that flange 34 of the shank applies compressive force to collar 35 of the rivet assembly. The compressive force causes the collar to shorten and expand so that the rivet assembly is fastened to the work material. FIG. 2 illustrates the apparatus at this stage of the operation. Continued motion of parts 30 and 31 then causes shank portion 36, the expendable portion of the shank extending from necked section 37 to end 38, to break off from the rivet assembly. The sudden reduction of force caused by the break then allows rapid increase in the speed of the motion of parts 30 and 31 and a corresponding reduction in the force of the grip of the jaws on the expendable portion of the shank. The increased motion speed and the release by the jaws cause the expendable portion to be ejected from the head via hole 39 in part 31. FIG. 3 illustrates the apparatus at this stage of the operation.

Figure 4:
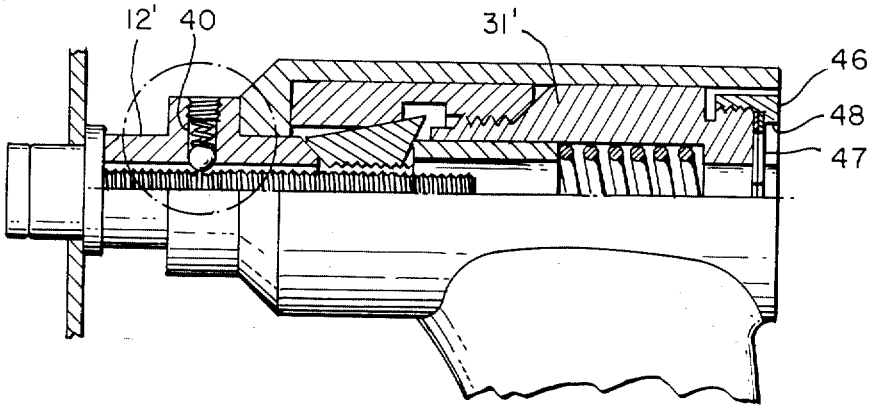
FIG. 4 is a sectional view of the head of the tool incorporating the subject invention and with a rivet assembly inserted ready for installation.
Figure 4A:
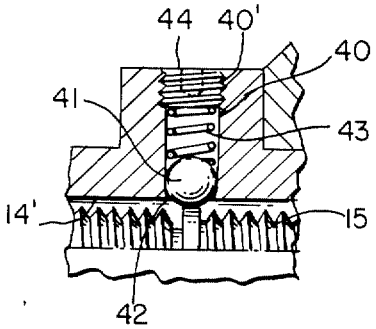
FIG. 4A is an enlarged view of the circled area of FIG. 4.

FIG. 4 illustrates the apparatus ready for operation to install a rivet assembly with the subject invention incorporated. FIG. 4A is an enlarged view of the circle area of FIG. 4. Tip 12' incorporates apparatus for retaining the rivet assembly during tool maneuvering as previously described. The apparatus fits in hole 40. Ball 41 is inserted in hole 40 and prevented from entering hole 14 by lip 42. Compression spring 43 is installed between ball 41 and screw 44 installed in threaded portion 40' of hole 40 to retain the spring and ball. The compression force of spring 43 is sufficient to make the friction force between ball 41 and the rivet shank 15 greater than the weight of the rivet assembly so the rivet assembly is retained in the tool head even when hole 14 is vertical and the head end of the rivet assembly is in the down direction. One detent assembly is shown for simplification of the disclosure. In a preferred embodiment, two detent assemblies are used, diametrically disposed in the nose piece.

Still referring to FIG. 4, the apparatus for retaining shank portion 36 inside the tool head until it is expelled by the insertion of another rivet assembly comprises wafer(s) 45, made of resilient material and held in place on part 31 by cap 46 which is screwed onto threaded portion 47 added to part 31 for the purposes of the invention. The outer, cylindrical surface is knurled.

In FIG. 5, the rivet assembly has been installed and the expendable portion of the shank has been separated from the assembly and trapped inside the head by wafer(s) 45. The parentheses around the letter s in the words wafers indicates that one wafer may be used, but two (the preferred embodiment) are shown. Three or more wafers may be used. FIG. 5A shows a wafer in plane view. The wafer 45 is circular with hole 46 at its center and slits 47 radiating from the hole. The slits terminate at a diameter approximating the inner diameter 48 of cap 46. The diameter of hole 46 is smaller than the diameter of shank portion 28. The segments 49, between the slits, are integral with rim 50 and function as leaf springs as shown in FIG. 6.

In FIG. 6 the head has returned to its initial state, ready for another operation, and a rivet assembly has been inserted into the nose piece of the head and its shank has forced expendable shank portion 28 through wafer(s) 45 with segments 49 deflecting to enlarge the opening of hole 46 to allow partial exit of the expendable shank portion. As indicated in FIG. 6, the expendable shank portion 36 partially exits the head when a rivet assembly 16 is inserted. This happens because the length X of this shank of the rivet assembly plus the length Y of the expendable shank portion 36 exceeds length Z of the tool head. It is also enabled by the essential coincidence of the longitudinal axes of the nose 12', casing 11 and retention wafer(s) 45. The shank portion can be grasped by its exposed portion and removed.

It is considered to be made clear from this description that the subject invention meets its objectives. Rivet assemblies are retained while the tool is maneuvered into positions for rivet installations and the expendable portions of the rivet shanks are retained for removal by the operator. Further, while a preferred embodiment of the invention is described, it will be understood by those skilled in the art that other embodiments and modifications of those described are possible within the scope of the invention which is limited only by the scope of the appended claims.

What is claimed is:

1. The head of a blind rivet installation tool, said rivet assemblies having shanks with expendable portions thereon, said shanks with expandable portions having a first length, said expendable portions having a second length, said head having a first longitudinal axis and a third length and comprising:

a tip, said tip having a first bore extending therethrough insertion of said shanks, said first bore having a second longitudinal axis, said tip further comprising detent means for retaining said shanks in said first bore, a casing having a first end, a second end, and a third longitudinal axis, retention means having a second bore extending therethrough for exit of said expendable portions, said second bore having a fourth longitudinal axis, said tip being attached to said first end of said casing, said retention means being installed in said second end of said casing, said first, second, third and fourth longitudinal axes being essentially coincident, the sum of said first and second lengths being greater than said third length, whereby insertion of a rivet assembly into said first bore will cause one of said expendable portions retained in said head to partially exit through said second bore.

2. The head of claim 1 wherein said retention means comprises at least one wafer, said wafer comprising:

a rim, a first center, and a plurality of segments having first ends and second ends, said first ends being integral with said rim, said segments extending from said rim toward said first center, said second ends forming a segmented periphery of said second hole, said second hole having a second center, said first and second centers being essentially coincident.

3. The head of claim 2 in which said retention means comprises two of said wafers.

4. The head of claim 2 in which said retention means comprises three of said wafers.

* * * * *